US007384311B2

(12) United States Patent
Sharf et al.

(10) Patent No.: US 7,384,311 B2
(45) Date of Patent: Jun. 10, 2008

(54) ELECTRICAL CONNECTOR HAVING CONTACT MODULES WITH TERMINAL EXPOSING SLOTS

(75) Inventors: Alex Michael Sharf, Harrisburg, PA (US); Brent Ryan Rothermel, Harrisburg, PA (US); Chad William Morgan, Mechanicsburg, PA (US); David Wayne Helster, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/362,618

(22) Filed: Feb. 27, 2006

(65) Prior Publication Data

US 2007/0202747 A1 Aug. 30, 2007

(51) Int. Cl.
*H01R 13/648* (2006.01)

(52) U.S. Cl. ..... 439/608

(58) Field of Classification Search ..... 439/608, 439/79, 80, 108, 607, 701
See application file for complete search history.

(56) References Cited

U.S. PATENT DOCUMENTS 5,104,341 A 4/1992 Gilissen et al.
5,342,211 A 8/1994 Broeksteeg
5,496,183 A 3/1996 Soes et al.
5,795,191 A 8/1998 Preputnick et al.
6,347,962 B1 2/2002 Kline
6,461,202 B2 10/2002 Kline
6,471,549 B1 10/2002 Lappohn
6,551,140 B2 * 4/2003 Billman et al. ..... 439/608
6,808,420 B2 10/2004 Whiteman, Jr. et al.
6,969,280 B2 * 11/2005 Chien et al. ..... 439/608
7,104,808 B2 * 9/2006 Korsunsky et al. ..... 439/76.1
7,172,461 B2 * 2/2007 Davis et al. ..... 439/608

* cited by examiner

*Primary Examiner*—Javaid H. Nasri

(57) ABSTRACT

An electrical connector includes a housing and a contact module mounted in the housing. The contact module includes a mating edge and a mounting edge, and a lead frame having terminals extending between the mating and mounting edges. The contact module has an insulated body with a side surface, and the insulated body includes a slot open from the side surface to expose at least some of the terminals. Each of the terminals exposed by the slot has a respective exposed portion in the slot, and each exposed portion has an equal length.

15 Claims, 8 Drawing Sheets

ELECTRICAL CONNECTOR HAVING CONTACT MODULES WITH TERMINAL EXPOSING SLOTS

BACKGROUND OF THE INVENTION

This invention relates generally to high speed electrical connectors, and more particularly, to electrical connectors having lead frames enclosed within molded housings.

With the ongoing trend toward smaller, faster, and higher performance electrical components such as processors used in computers, routers, switches, etc., it has become increasingly important for the electrical interfaces along the electrical paths to also operate at higher frequencies and at higher densities with increased throughput.

In a traditional approach for interconnecting circuit boards, one circuit board serves as a back plane and the other as a daughter board. The back plane typically has a connector, commonly referred to as a header, that includes a plurality of signal pins or contacts which connect to conductive traces on the back plane. The daughter board also includes a connector, commonly referred to as a receptacle, that includes a plurality of contacts or pins. Typically, the receptacle is a right angle connector that interconnects the back plane with the daughter board so that signals may be routed therebetween. The right angle connector typically includes a mating face that receives the plurality of signal pins from the header on the back plane, and contacts that connect to the daughter board.

At least some right angle connectors include a plurality of contact modules that are received in a housing. The contact modules typically include a lead frame encased in a dielectric body. The body is manufactured using an over-molding process. However, because the terminals of the lead frame tend to move and shift position during the molding process, the terminals are typically held in place during the molding process by securing members or fingers. When the securing members are removed, voids or pinch points remain in the body of the contact modules. The voids expose, to air, at least a portion of the terminals of the lead frame. Hence, certain areas between the terminals are encased in the dielectric body, while other areas are exposed to air. The transitions of the terminals between the different environments are generally non-uniform, which causes signal degradation, particularly of terminals functioning as differential pairs.

Some older connectors, which are still in use today, operate at speeds of less than one gigabit per second. By contrast, many of today's high performance connectors are capable of operating at speeds of up to ten gigabits or more per second. The signal degradation caused by the voids in the contact modules are becoming a problem in the high performance connectors in use today.

A need remains for a low cost connector with improved electrical characteristics such as reduced signal degradation and increased throughput.

BRIEF DESCRIPTION OF THE INVENTION

In one aspect, an electrical connector is provided including a housing and a contact module mounted in the housing. The contact module includes a mating edge and a mounting edge, and a lead frame having terminals extending between the mating and mounting edges. The contact module has an insulated body with a side surface, and the insulated body includes a slot open from the side surface to expose at least some of the terminals. Each of the terminals exposed by the slot has a respective exposed portion in the slot, and each exposed portion has an equal length.

Optionally, the contact module may include a second slot open from the side surface to expose at least some of the terminals, wherein the second slot exposes the same terminals as the first slot. Each of the terminals exposed by the first slot and the second slot may be exposed to an equal amount of air. The second slot may expose different terminals than the first slot. In some embodiments, a plurality of terminals may be arranged as multiple differential pairs, wherein the slot exposes all of the plurality of terminals by equal amounts to air. Ground terminals may extend between adjacent differential pairs, wherein the slot exposes the ground terminals. In one embodiment, the contact module may include first to second slots on the side surface. A plurality of terminals may be arranged as multiple differential pairs, wherein the first and second slots entirely traverse the plurality of terminals. Optionally, the first slot may be oriented parallel to the mating edge and the second slot may be oriented parallel to the mounting edge.

In another aspect, a contact module for an electrical connector is provided including a lead frame having terminals extending between mating contacts and mounting contacts. The terminals define at least one transmission unit extending along a transmission path. The contact module also includes an insulated body having opposing first and second side surfaces, wherein the terminals are positioned between the first and second side surfaces. The insulated body includes a plurality of elongated slots open from the first side surface, and each slot is arranged to expose terminals of the transmission unit to a substantially equal amount of air along the transmission path.

DETAILED DESCRIPTION OF THE INVENTION

Figure 1:
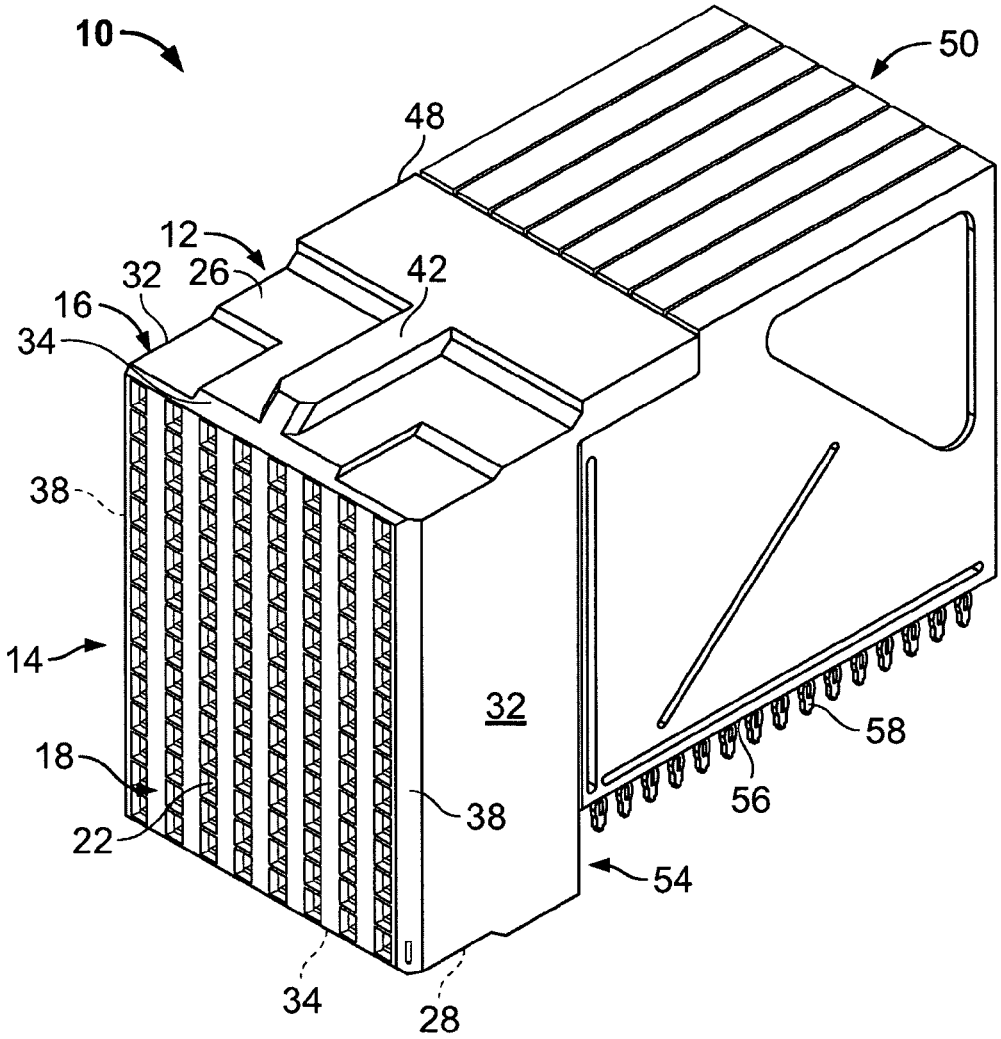
FIG. 1 is a perspective view of an electrical connector formed in accordance with an exemplary embodiment of the present invention.

FIG. 1 illustrates an electrical connector 10 formed in accordance with an exemplary embodiment of the present invention. While the connector 10 will be described with particular reference to a receptacle connector, it is to be understood that the benefits herein described are also applicable to other connectors in alternative embodiments. The following description is therefore provided for purposes of illustration, rather than limitation, and describes only a few potential applications.

The connector 10 includes a dielectric housing 12 having a forward mating end 14 that includes a shroud 16 and a mating face 18. The mating face 18 includes a plurality of mating contacts 20 (shown in FIG. 3), such as, for example, contacts within contact cavities 22, that are configured to receive corresponding mating contacts (not shown) from a mating connector (not shown). The shroud 16 includes an upper surface 26 and a lower surface 28 between opposed sides 32. The upper and lower surfaces 26 and 28, respectively, each includes a chamfered forward edge 34. The sides 32 each include chamfered side edges 38. An alignment rib 42 is formed on the upper shroud surface 26 and lower shroud surface 28. The chamfered edges 34 and 38 and the alignment ribs 42 cooperate to bring the connector 10 into alignment with the mating connector during the mating process so that the contacts in the mating connector are received in the contact cavities 22 without damage.

The housing 12 also includes a rearwardly extending hood 48. A plurality of contact modules 50 are received in the housing 12 from a rearward end 54. The contact modules 50 define a connector mounting face 56. The connector mounting face 56 includes a plurality of contacts 58, such as, for example, pin contacts, or more particularly, eye-of-the-needle-type contacts, that are configured to be mounted to a substrate (not shown), such as a circuit board. In an exemplary embodiment, the mounting face 56 is substantially perpendicular to the mating face 18 such that the connector 10 interconnects electrical components that are substantially at a right angle to one another.

Figure 2:
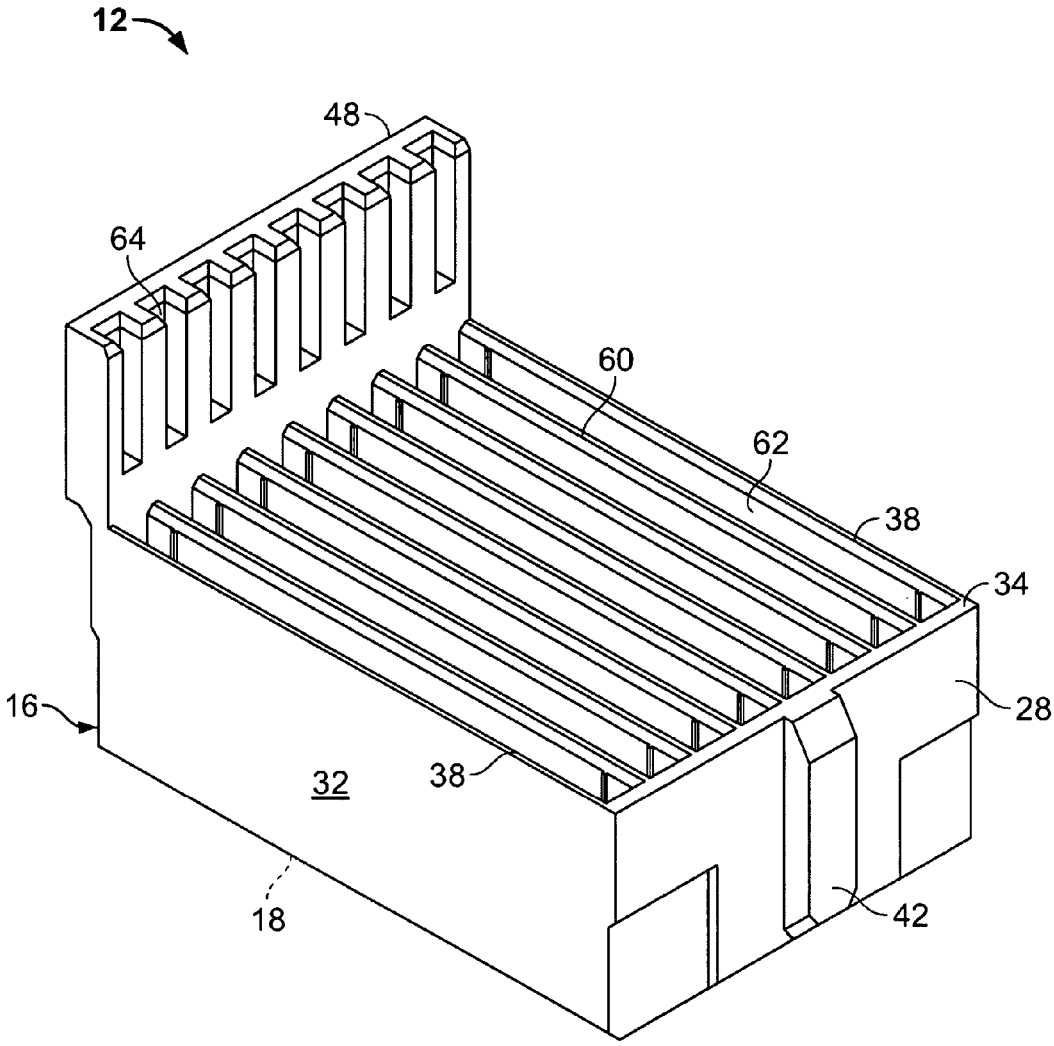
FIG. 2 is a rear perspective view of a housing of the electrical connector shown in FIG. 1.

FIG. 2 illustrates a rear perspective view of the housing 12. The housing 12 includes a plurality of dividing walls 60 that define a plurality of chambers 62. The chambers 62 receive a forward portion of the contact modules 50 (FIG. 1). A plurality of slots 64 are formed in the hood 48. The slots 64 have equal width. The chambers 62 and slots 64 cooperate to stabilize the contact modules 50 when the contact modules 50 are loaded into the housing 12.

Figure 3:
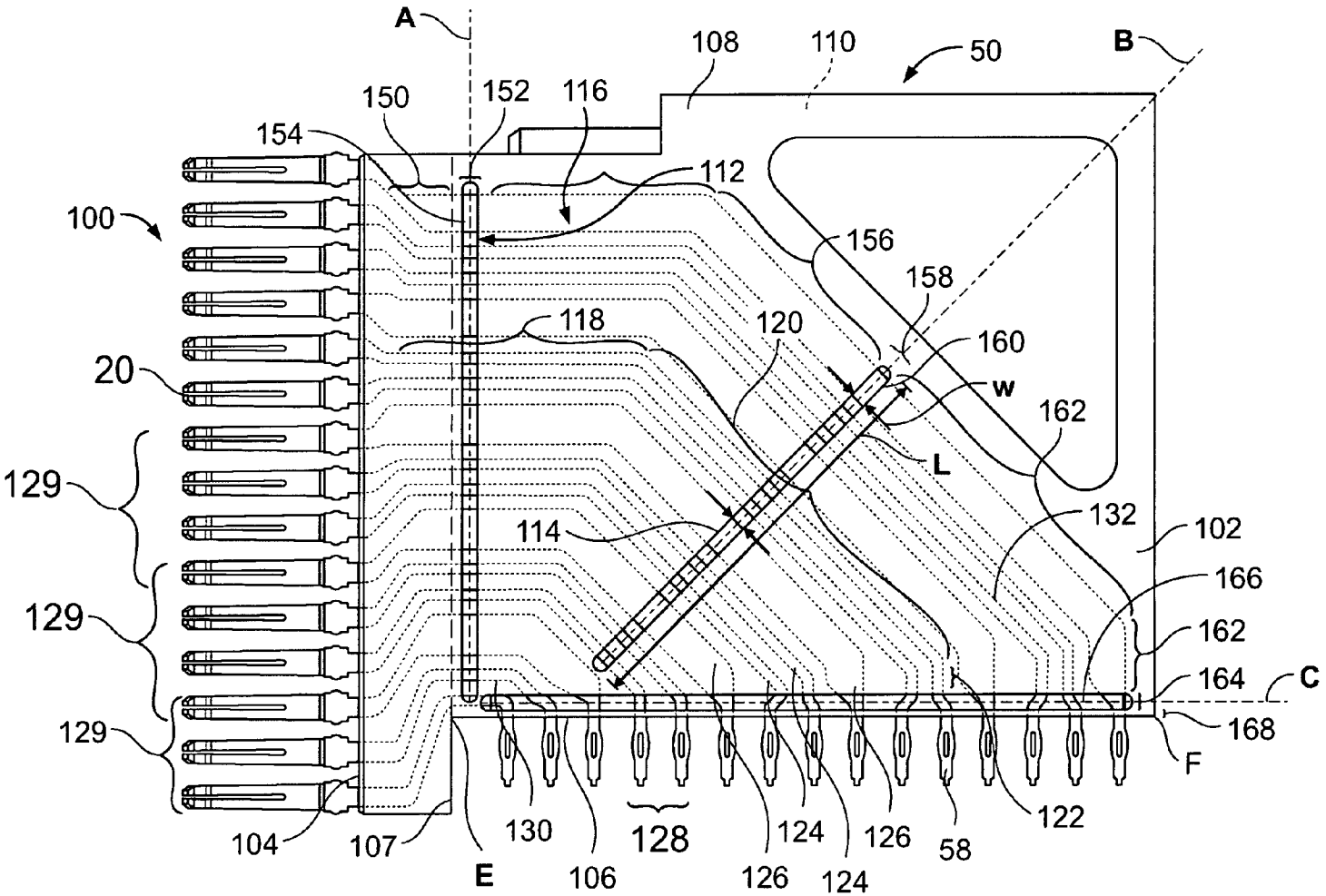
FIG. 3 is a side view of a contact module of the electrical connector shown in FIG. 1, and showing a lead frame in phantom outline.
Figure 4:
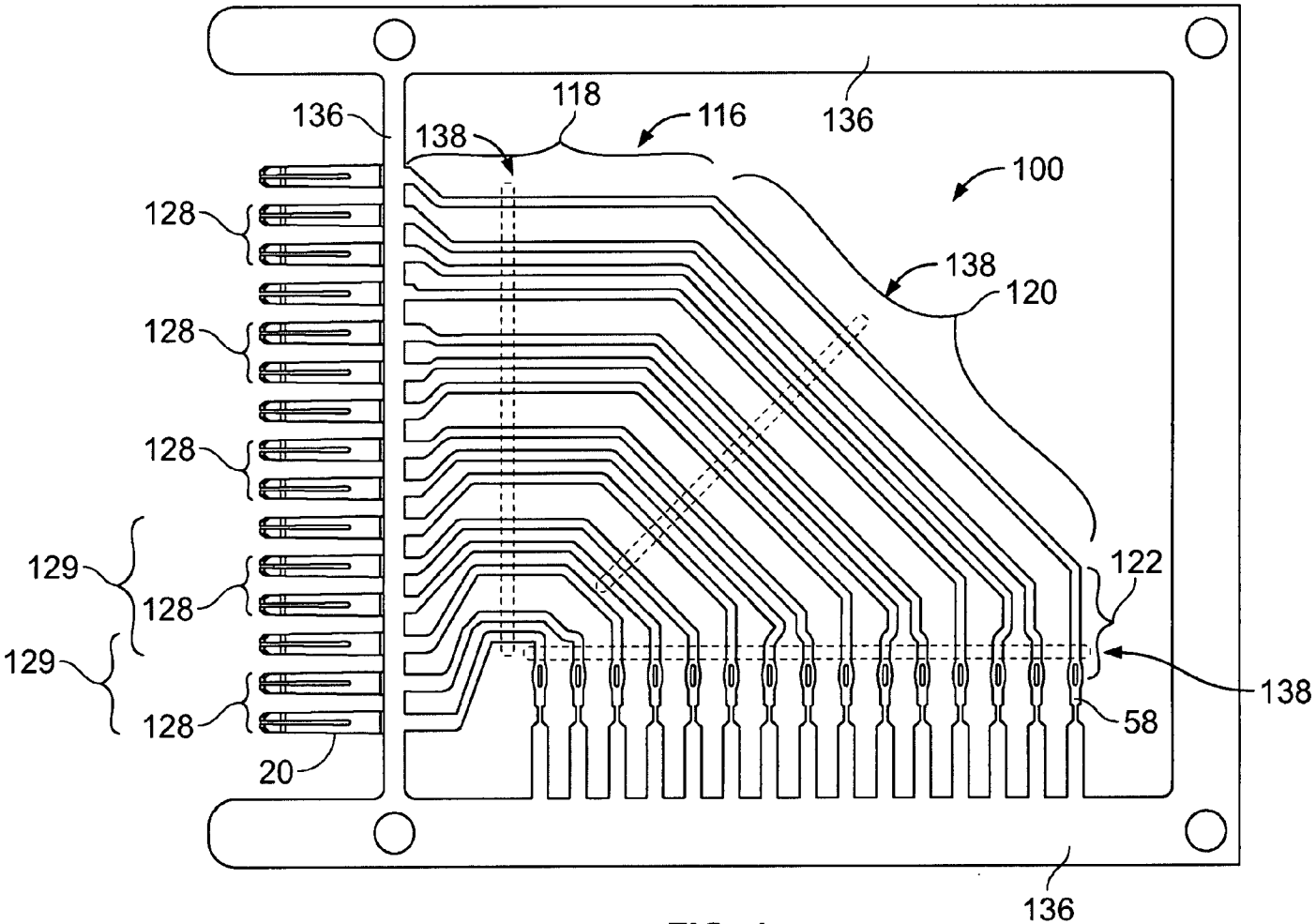
FIG. 4 is a side view of a lead frame held within carrier strips.

FIG. 3 illustrates a single contact module 50 that includes an internal lead frame 100, partially shown in phantom outline. The lead frame 100 includes a plurality of terminals 116 enclosed within a dielectric body 102. FIG. 4 illustrates the lead frame 100 while held by carrier strips 136.

The body 102 is fabricated from a dielectric material, such as a plastic material, and encases the lead frame 100. The mating contacts 20 extend from a mating edge 104 of the body 102 and the mounting contacts 58 extend from a mounting edge 106 of the body 102. The mounting edge 106 intersects with a rearward facing end wall 107 proximate the mating edge 104. Alternatively, the mating edge 104 may intersect the mounting edge 106. The body 102 includes opposed first and second planar side surfaces 108 and 110, respectively. The side surfaces 108 and 110 extend substantially parallel to and along the lead frame 100.

In one embodiment, the body 102 is manufactured using an over-molding process. During the over-molding process, the lead frame 100 is encased in a dielectric material, such as a plastic material, which forms the body 102. However, during the molding process, elongated slots or voids 112 are created, which extend through the first and/or second surfaces 108 and/or 110. The slots 112 extend to the lead frame 100 such that portions of the lead frame 100 are exposed through the slots 112.

As illustrated in FIG. 3, the first side surface 108 includes slots 112 arranged in a predetermined pattern. Additionally, the second side surface 110 includes slots 112 arranged in a similar pattern. The slots 112 have a width W and a length L. The slots 112 have side walls 114 extending parallel to one another along the length L of the slots 112. The width W is approximately equal to a width of the terminals 116, however, the width W may be greater than or less than the width of the terminals 116. The length L is generally at least twice the width W for each slot 112. Optionally, the length L may be substantially more than twice the width W. The slots 112 may be square, rectangular, elliptical, oval, and the like. The slots 112 expose portions of the terminals 116 of the lead frame 100. Generally, each slot 112 extends perpendicular to the terminals 116 such that the length L of each slot 112 is oriented transverse to the direction of current flow or signal propagation through the exposed portions of the terminals 116. In one embodiment, the slots 112 may be oriented such that a length L extends parallel to one of the mating edge 104 or the mounting edge 106. Optionally, the slots 112 may be oriented perpendicular to one of the mating edge 104 or the mounting edge 106. Alternatively, the slots 112 may be oriented at an acute angle with respect to the mating or mounting edges 104 or 106.

In FIG. 3, the slots 112 have parallel side walls 114 and ends that are elliptical. The slots 112 are aligned along axes (e.g. A-C) extending generally radially outward from a portion of the contact module 50 proximate the intersection of the mounting edge 106 and the rearward facing end wall 107. The particular orientation of slots 112 will be explained below in more detail, and are not limited to the orientations illustrated in these figures.

The lead frame 100 includes a plurality of terminals 116 that extend along predetermined paths to electrically connect each mating contact 20 to a corresponding mounting contact 58. The terminals 116 extend between the mating and mounting contacts 20 and 58, respectively. In one embodiment, the terminals 116 include a mating contact portion 118, an intermediate terminal portion 120, and a mounting contact portion 122. The mating contact portion 118 extends generally perpendicular to the mating edge 104. The mounting contact portion 122 extends generally perpendicular to the mounting edge 106. The intermediate terminal portion 120 extends between the mating and mounting contact portions 118 and 122. In one embodiment, the intermediate terminal portion 120 extends obliquely between the mating and mounting contact portions 118 and 122. Optionally, the intermediate terminal portion 120 may extend at approximately a forty-five degree angle between the mating and mounting contact portions 118 and 122.

The terminals 116 may be either signal terminals 124 or ground terminals 126. In one embodiment, adjacent signal terminals 124 function as a differential pair 128, and each differential pair 128 may be separated by a ground terminal 126. Each differential pair 128, corresponding ground terminals 126, and mating and mounting contacts 20 and 58 operate as a transmission unit 129. Optionally, the transmission unit 129 may include the mating and mounting contacts 20 and 58. The transmission unit 129 may also extend through the mating connector such that the transmission unit extends from a board surface of a main board to a board surface of a daughter board.

Each terminal 124 or 126 in the transmission unit 129 interacts with one another, and each terminal 124 or 126 has a different mode of propagation. For example, a first mode of propagation exists between the two signal terminals 124 of the differential pair 128. A second mode of propagation exists between one of the signal terminals 124 and the adjacent ground terminal 126. A third mode of propagation exists between the two ground terminals 126 extending on either side of the differential pair 128. Optionally, the modes of propagation extend to the inner edges of the ground terminals 126, or the edge of the ground terminal adjacent the signal terminal 124. Interference and signal degradation occurs when the various modes of propagation are transmitted at different speeds or arrive at an end of the terminals 124 or 126 at different times. A factor affecting the mode of propagation is the medium or dielectric material surrounding the terminals 124 or 126. For example, each of the terminals 124 and 126 are substantially encased in the plastic body 102, but portions of the terminals 124 and 126 are exposed to air in the slots 112. The medium (e.g. air or plastic) affects the interactions between the signal terminals 124, between the signal and ground terminals 124 and 126, and between the ground terminals 126. The pattern, positioning and size of the slots 112 thus affects the signal integrity. In the exemplary embodiment, a substantially equal amount of air is provided across each transmission unit 129 throughout the entire path of the unit 129 from the mating contacts 20 to the mounting contacts 58. Similarly, a substantially equal amount of plastic body 102 is provided across each transmission unit 129 throughout the entire path of the unit 129 from the mating contacts 20 to the mounting contacts 58. Other factors affecting the mode of propagation include the length, thickness and material of the terminals 116, and the interaction between surrounding terminals 116, including in-plane terminals and out-of-plane terminals, such as terminals of adjacent modules 50 within the connector 10.

Each signal terminal 124 of the differential pair 128 extends along a signal path from the mating contact 20 to the mounting contact 58. Optionally, the signal contacts 124 within a differential pair 128 have the same length, but the signal contacts 124 of adjacent differential pairs 128 have different lengths. For example, the innermost differential pair 128 (e.g. the differential pair 128 along the mounting edge 106 nearest the mating edge 104, such as at point E) has a signal path length, generally shown by 130. The outermost differential pair 128 (e.g. the differential pair 128 along the mounting edge 106 furthest from the mating edge 104, such as at point F) has a signal path length, generally shown by 132, which is substantially longer than the signal path length 130 of the innermost differential pair 128. The intermediate differential pairs 128 (e.g. the differential pairs 128 between the inner and outer most differential pairs 128) have signal path lengths between lengths 130 and 132. The slots 112 extend transverse to the signal paths.

As illustrated in FIG. 4, during manufacture, the lead frame 100 is attached to carrier strips 136, which are removed and discarded after the over-molding process that creates the contact modules 50. During manufacture of the contact module 50, the terminals 116 of the lead frame 100 are retained in place by elongated securing members 138 (shown in phantom), also referred to as fingers. The elongated securing members 138 span across a plurality of terminals 124 and 126 such that a single securing member 138 is utilized to secure multiple transmission units 129. The securing members 138 secure the lead frame 100 in a particular position while the plastic body 102 is molded around and encloses the lead frame 100, such that the lead frame 100 is sandwiched between the first and second side surfaces 108 and 110.

Optionally, the terminal portions 118, 120 and 122 of each terminal 116 may be separately secured in place by separate securing members 138. In one embodiment, the elongated securing members 138 span across a single transmission unit 129 such that each transmission unit 129 is secured by a separate securing member 138. Securing members 138 may be positioned along each terminal portion 118, 120 and 122 such that each terminal 116 is secured by multiple securing members 138.

The slots 112, as illustrated in FIG. 3, are created by the elongated securing members 138. For example, after the molding process, when the securing members are removed, the slots 112 remain in the body 102. The slots 112 expose the portions of the terminals 116 to an air environment. By having a single securing member span across each terminal 116 in the transmission unit 129, each terminal 116 is substantially equally exposed to the air environment along the signal path. As a result, signals transmitted along the differential pair 128 are exposed to a common homogeneous environment along portions of the signal paths. For example, the signal paths are in either an all dielectrically encased environment, or the signal paths are in an all air environment. Additionally, the terminals 116 of each differential pair 128 transition between the different environments simultaneously.

In the illustrated embodiment of FIG. 3, the terminals 116 have a first portion 150 extending from the mating edge 104. Each terminal first portion 150 is encased in the dielectric body 102. The terminals 116 have a second portion 152 which is exposed to an all air environment within a first slot 154. The terminals 116 have a third portion 156 which is encased in the dielectric body 102. The terminals 116 have a fourth portion 158 which is exposed to an all air environment within a second slot 160. The terminals 116 have a fifth portion 162 which is encased in the dielectric body 102. The terminals 116 have a sixth portion 164 which is exposed to an all air environment within a third slot 166. The terminals 116 have a seventh portion 168 extending from the third slot 166 to the mounting edge 106. Each terminal seventh portion 168 is encased in the dielectric body 102. As such, each terminal 116 of each differential pair 128 simultaneously transitions from an encased environment to an open or exposed air environment. However, the terminals 116 may have more or less portions depending on the number of slots 112.

Figure 5:
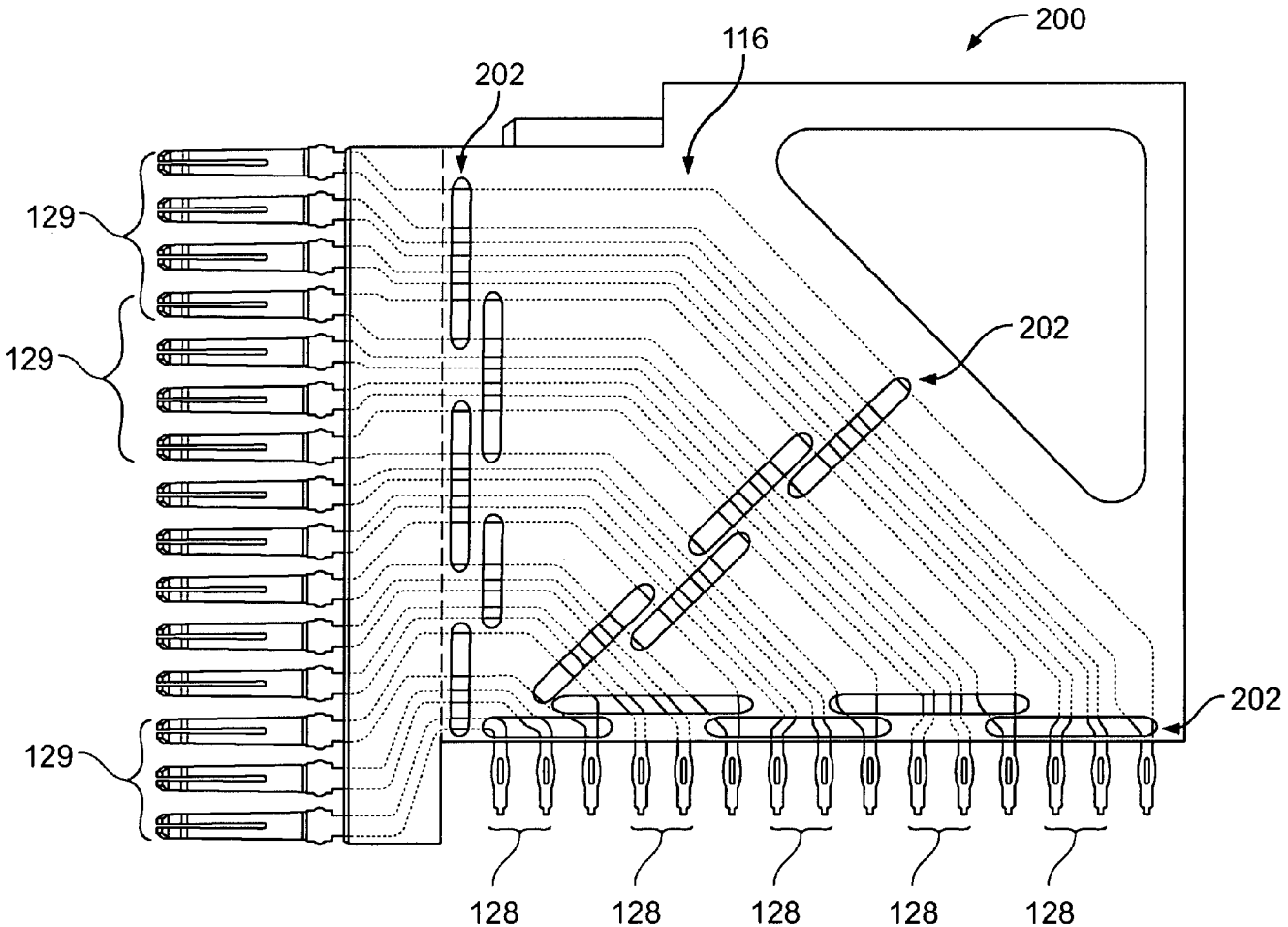
FIG. 5 is a side perspective view of a contact module formed in accordance with an alternative embodiment of the present invention.

FIG. 5 is a side perspective view of an alternative contact module 200. The contact module 200 is similar to the contact module 50 (shown in FIGS. 1-3), and as such, like reference numerals are used to identify like components. The contact module 200 includes discrete, elongated slots 202 oriented to expose terminals 116 of one transmission unit 129. For example, each slot 202 exposes two ground terminals 126 and two signal terminals 124. Additionally, another slot 202 exposes another transmission unit 129. The slots 202 may be aligned in rows, as illustrated in FIG. 5, wherein adjacent slots 202 are off-set with respect to one another, but aligned with other slots 202 in a row.

As with the contact module 50, the pattern, positioning and size of the slots 202 of the contact module 200 affect the signal integrity of the terminals 116. The contact module 200 of the illustrated embodiment of FIG. 5 provides substantially equal amounts of air across each transmission unit 129 throughout the entire path of the unit 129 from the mating contacts 20 to the mounting contacts 58. Similarly, a substantially equal amount of plastic body 102 is provided across each transmission unit 129 throughout the entire path of the unit 129 from the mating contacts 20 to mounting contacts 58. The modes of propagation are thus controlled.

Figure 6:
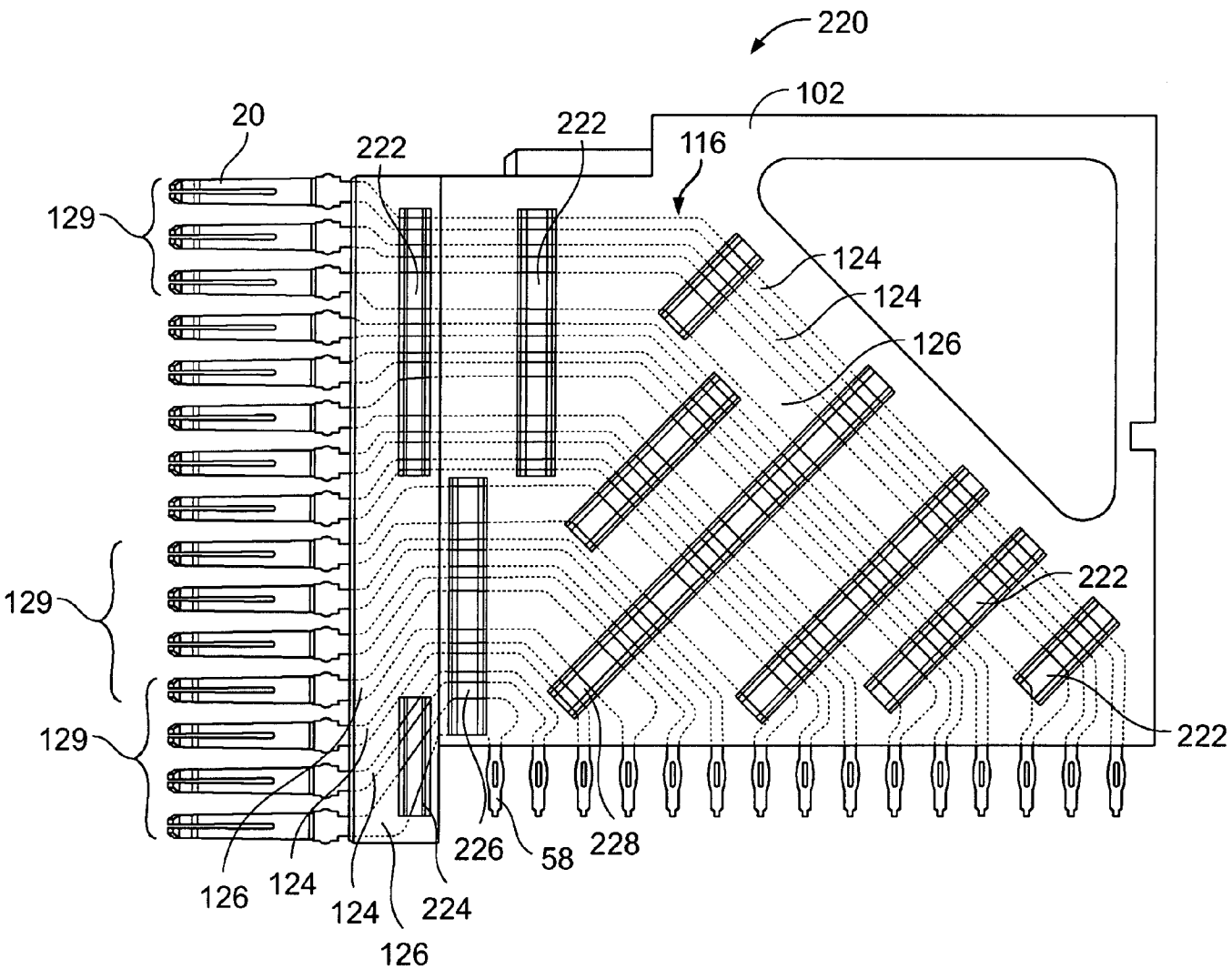
FIG. 6 is a side perspective view of another alternative contact module.

FIG. 6 is a side perspective view of another alternative contact module 220. The contact module 220 is similar to the contact module 50 (shown in FIGS. 1-3), and as such, like reference numerals are used to identify like components. The contact module 220 includes discrete, elongated slots 222 oriented to expose terminals 116 of one transmission unit 129. For example, each slot 222 generally exposes two ground terminals 126 and two signal terminals 124. However, in the illustrated embodiment of FIG. 6, one of the transmission units 129 includes a single ground terminal 126 and two signal terminals 124. For example, due to space constraints of the module 220, or to standards of the connector 10, the outermost ground terminal 126 is removed.

In the illustrated embodiment of FIG. 6, the slots 222 exposing the innermost transmission unit 129 include a first slot 224 exposing a single ground terminal 126 and a single signal terminal 124, a second slot 226 exposing two ground terminals 126 and two signal terminals 124 of the transmission unit 129, and a third slot 228 exposing a single ground terminal 126 and a single signal terminal 124 of the transmission unit 129. As a result, each of the first, second and third modes of propagation are controlled by the slots 222, and each of the terminals 116 are exposed to a substantially equal amount of air, although the exposure occurs at different parts of the signal path of the transmission unit 129.

In the illustrated embodiment of FIG. 6, the slots 222 exposing the outermost transmission unit 129 only expose a single ground terminal 126 and two signal terminals 124. As a result, each of the first and second modes of propagation are controlled by the slots 222, and the third mode of propagation does not exist.

As with the contact module 50, the pattern, positioning and size of the slots 222 of the contact module 220 affect the signal integrity of the terminals 116. The contact module 220 of the illustrated embodiment of FIG. 6 provides substantially equal amounts of air across each transmission unit 129 throughout the entire path of the unit 129 from the mating contacts 20 to the mounting contacts 58. Similarly, a substantially equal amount of plastic body 102 is provided across each transmission unit 129 throughout the entire path of the unit 129 from the mating contacts 20 to mounting contacts 58. The modes of propagation are thus controlled.

Figure 7:
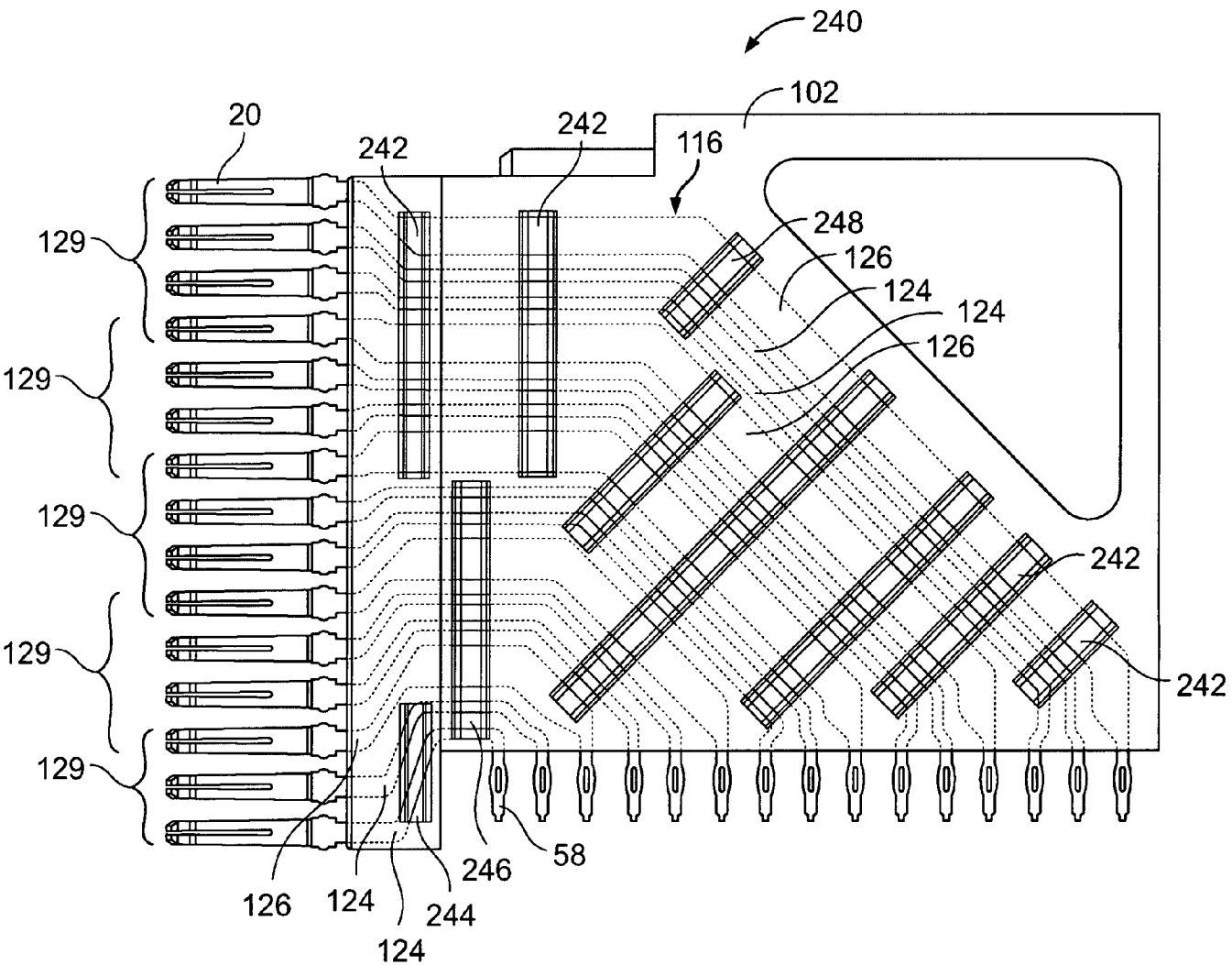
FIG. 7 is a side perspective view of yet another alternative contact module.

FIG. 7 is a side perspective view of another alternative contact module 240. The contact module 240 is similar to the contact module 50 (shown in FIGS. 1-3), and as such, like reference numerals are used to identify like components. The contact module 240 includes discrete, elongated slots 242 oriented to expose terminals 116 of one transmission unit 129. For example, each slot 242 generally exposes two ground terminals 126 and two signal terminals 124. However, in the illustrated embodiment of FIG. 7, one of the transmission units 129 includes a single ground terminal 126 and two signal terminals 124. For example, due to space constraints of the module 240, or to standards of the connector 10, the innermost ground terminal 126 is removed.

In the illustrated embodiment of FIG. 7, the slots 242 exposing the innermost transmission unit 129 include a first slot 244 exposing two signal terminals 124 of the transmission unit 129, and a second slot 246 exposing a single ground terminal 126 and two signal terminals 124 of the transmission unit 129. As a result, each of the first and second modes of propagation are controlled by the slots 242, and the third mode of propagation does not exist.

In the illustrated embodiment of FIG. 7, the slots 242 exposing the outermost transmission unit 129 include a third slot 248. The third slot 248 only exposes a single ground terminal 126 and two signal terminals 124. As a result, each of the first and second modes of propagation are controlled by each of the slots 242 exposing the outermost transmission unit 129. The third mode of propagation is not controlled by the third slot 248, however, other slots 242 exposing the outermost transmission unit 129 are used to at least partially control the third mode of propagation of the outmost transmission unit 129.

As with the contact module 50, the pattern, positioning and size of the slots 242 of the contact module 240 affect the signal integrity of the terminals 116. The contact module 240 of the illustrated embodiment of FIG. 7 provides substantially equal amounts of air across each transmission unit 129 throughout the entire path of the unit 129 from the mating contacts 20 to the mounting contacts 58. Similarly, a substantially equal amount of plastic body 102 is provided across each transmission unit 129 throughout the entire path of the unit 129 from the mating contacts 20 to mounting contacts 58. The modes of propagation are thus controlled.

In one embodiment, the contact modules 220 and 240 illustrated in FIGS. 6 and 7, respectively, may be used together in the connector 10. For example, by alternating the contact modules 220 and 240 within the connector 10, the ground terminals 126 of the contact module 220 are substantially aligned with, or overlay, the signal terminals 124 of the contact module 240. Additionally, the ground terminals 126 of the contact module 240 are substantially aligned with, or overlay, the signal terminals 124 of the contact module 220. As a result, the overall signal integrity of each of the contact modules 220 and 240 is increased.

Figure 8:
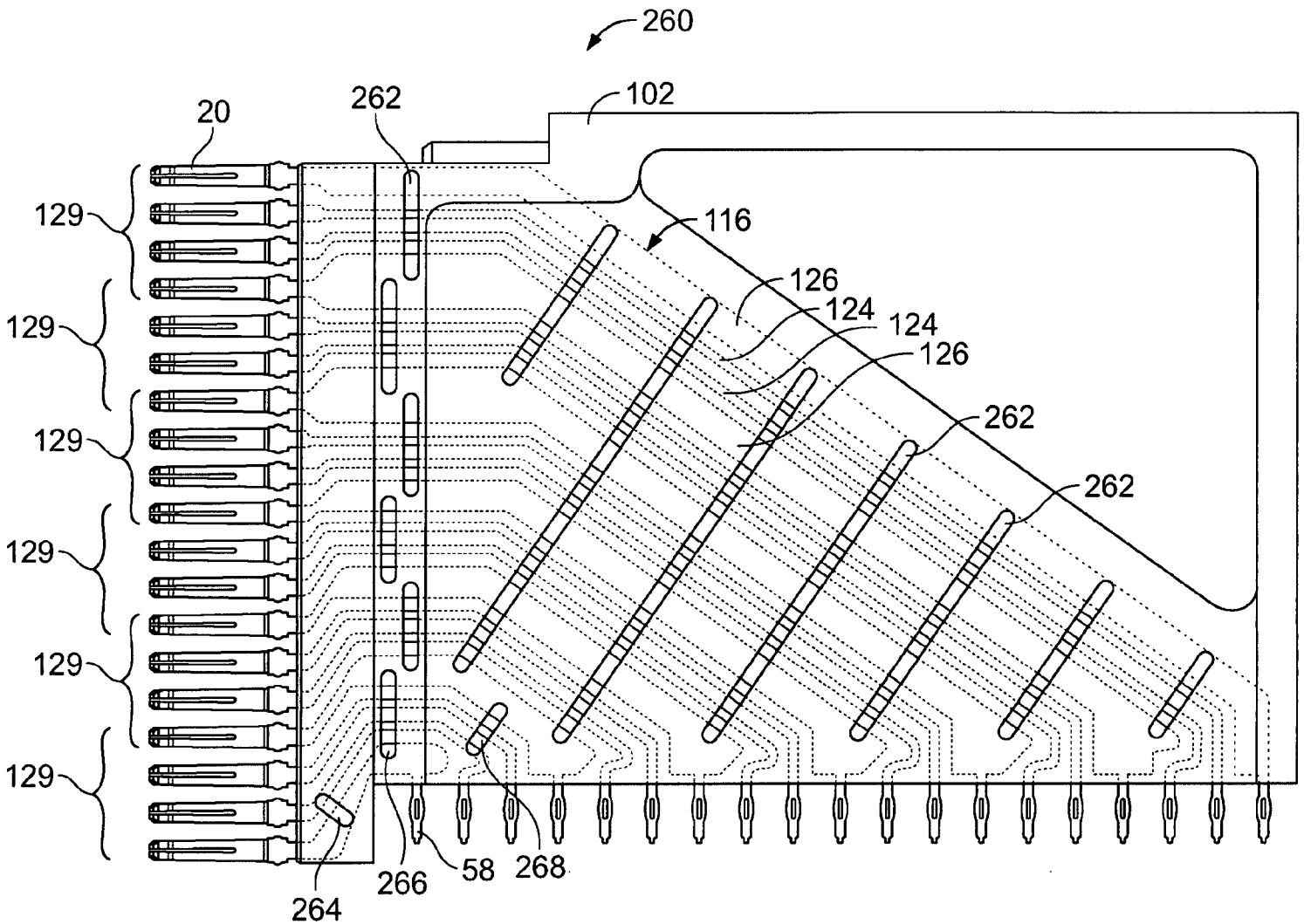
FIG. 8 is a side perspective view of a further alternative contact module.

FIG. 8 is a side perspective view of yet another alternative contact module 260. The contact module 260 is similar to the contact module 50 (shown in FIGS. 1-3), and as such, like reference numerals are used to identify like components. The contact module 260 includes discrete, elongated slots 262 oriented to expose terminals 116 of one transmission unit 129. For example, each slot 262 generally exposes two ground terminals 126 and two signal terminals 124. However, in the illustrated embodiment of FIG. 8, the slots 262 exposing the innermost transmission unit 129 include a first slot 264 exposing a single ground terminal 126 and a single signal terminal 124 of the transmission unit 129, a second slot 266 exposing two signal terminals 124 and two ground terminals 126 of the transmission unit 129, and a third slot 268 exposing a single ground terminal 126 and two signal terminals 124 of the transmission unit 129. As a result, each of the first, second, and third modes of propagation are controlled by the slots 262.

As with the contact module 50, the pattern, positioning and size of the slots 262 of the contact module 260 affect the signal integrity of the terminals 116. The contact module 260 of the illustrated embodiment of FIG. 8 provides substantially equal amounts of air across each transmission unit 129 throughout the entire path of the unit 129 from the mating contacts 20 to the mounting contacts 58. Similarly, a substantially equal amount of plastic body 102 is provided across each transmission unit 129 throughout the entire path of the unit 129 from the mating contacts 20 to mounting contacts 58. The modes of propagation are thus controlled.

The embodiments herein described provide an electrical connector 10 having improved electrical characteristics as compared to electrical connectors having contact modules with pinch point-type voids which isolate individual terminals. The contact modules 50 have slots 112 exposing multiple terminals 116, and particularly, terminals 116 of at least one transmission unit 129. As such, the signal terminals 124 and the ground terminals 126 uniformly transition between different environments, which improves the overall mode of propagation between the terminals 116 and improves the transmission of signals along the terminals 116. As a result, the slots 112 allow the connector 10 to operate at higher frequencies with increased throughput.

While the invention has been described in terms of various specific embodiments, those skilled in the art will recognize that the invention can be practiced with modification within the spirit and scope of the claims.

What is claimed is:

1. An electrical connector comprising:

a housing; and a contact module mounted in said housing, said contact module comprising a mating edge and a mounting edge, and a lead frame having terminals extending between said mating and mounting edges, said terminals being arranged as transmission units, each said transmission unit including a pair of signal terminals and at least one adjacent ground terminal, said contact module having an insulated body with a side surface, said insulated body having a first slot open from said side surface and extending across at least one of said transmission units to expose the terminals of said at least one transmission unit, wherein each said terminal exposed by said first slot has a respective exposed portion in said first slot, and each said exposed portion has an equal length, and wherein said insulated body has a second slot open from said side surface and extending across said at least one transmission unit to expose the terminals of said at least one transmission unit, wherein said second slot exposes the same terminals as said first slot.

2. The electrical connector of claim 1, wherein said insulated body comprises a second side surface generally opposed to said side surface, said second side surface having a second side surface slot open from said second side surface to expose at least some of said terminals.

3. The electrical connector of claim 1, wherein each of said terminals exposed by said first slot and said second slot is exposed to an equal amount of air.

4. The electrical connector of claim 1, wherein said second slot extends parallel to said first slot.

5. The electrical connector of claim 1, wherein said second slot extends non-parallel to said first slot.

6. The electrical connector of claim 1, wherein said first slot extends across multiple said transmission units.

7. The electrical connector of claim 1, wherein said first slot has a length that extends transverse to a direction of signal propagation.

8. The electrical connector of claim 1, wherein said first slot has a constant width.

9. An electrical connector comprising:

a housing; and a contact module mounted in said housing, said contact module comprising a mating edge and a mounting edge, and a lead frame having terminals extending between said mating and mounting edges, said terminals being arranged as transmission units, each said transmission unit including a pair of signal terminals and at least one adjacent ground terminal, said contact module having an insulated body with a side surface, said insulated body having a first slot open from said side surface and extending across at least one of said transmission units to expose the terminals of said at least one transmission unit wherein each said terminal exposed by said first slot has a respective exposed portion in said first slot, and each said exposed portion has an equal length, and wherein said insulated body has a second slot open from said side surface and extending across at least one other of said transmission units to expose the terminals of said at least one other transmission unit, wherein said second slot exposes different terminals than said first slot.

10. The electrical connector of claim 9, wherein said insulated body comprises a second side surface generally opposed to said side surface, said second side surface having a second side surface slot open from said second side surface to expose at least some of said terminals.

11. The electrical connector of claim 9, wherein each of said terminals exposed by said first slot and said second slot is exposed to an equal amount of air.

12. The electrical connector of claim 9, wherein said second slot extends parallel to said first slot.

13. The electrical connector of claim 9, wherein said second slot extends non-parallel to said first slot.

14. The electrical connector of claim 9, wherein said first slot has a length that extends transverse to a direction of signal propagation.

15. The electrical connector of claim 9, wherein said first slot has a constant width.

* * * * *